US012704261B2

(12) United States Patent
Sampath et al.

(10) Patent No.: US 12,704,261 B2
(45) Date of Patent: Aug. 11, 2026

(54) FUEL NOZZLE FOR A TURBINE ENGINE COMBUSTOR

(71) Applicant: GENERAL ELECTRIC COMPANY, Schenectady, NY (US)

(72) Inventors: Karthikeyan Sampath, Bengaluru (IN); Pradeep Naik, Bengaluru (IN); Prithiviraaj Pet T, Madurai (IN); Pabitra Badhuk, Jhargram (IN); Aritra Chakraborty, Kolkata (IN); Praveen Kasthuri, Bengaluru (IN); Sibtosh Pal, Mason, OH (US); Michael T. Bucaro, Arvada, CO (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/652,153

(22) Filed: May 1, 2024

(65) Prior Publication Data

US 2025/0341311 A1 Nov. 6, 2025

(51) Int. Cl.

| | |
|---|---|
| ***F23R 3/28*** | (2006.01) |
| ***F23R 3/00*** | (2006.01) |
| ***F23R 3/14*** | (2006.01) |

(52) U.S. Cl.

CPC ..... *F23R 3/283* (2013.01); *F23R 3/002* (2013.01); *F23R 3/14* (2013.01); *F23R 2900/00014* (2013.01)

(58) Field of Classification Search

CPC .. F23R 2900/00014; F23R 3/14; F23R 3/286; F23R 3/283; F23R 3/002; F23R 3/10; F23R 3/28

See application file for complete search history.

(56) References Cited

U.S. PATENT DOCUMENTS

| | | | | |
|---|---|---|---|---|
| 4,409,787 | A | 10/1983 | Davi et al. | |
| 5,431,018 | A | 7/1995 | Keller | |
| 6,370,879 | B1 | 4/2002 | Stalder et al. | |
| 6,431,018 | B1 | 8/2002 | Okada et al. | |
| 6,820,431 | B2 | 11/2004 | McManus et al. | |
| 9,618,206 | B2 | 4/2017 | Genin et al. | |
| 10,718,525 | B2 | 7/2020 | Jorgensen et al. | |
| 2002/0124549 | A1 * | 9/2002 | Dittmann | F23C 7/008 60/39.23 |
| 2005/0229581 | A1 | 10/2005 | Bellucci et al. | |

(Continued)

FOREIGN PATENT DOCUMENTS

| | | | |
|---|---|---|---|
| CN | 104595928 | B | 2/2020 |
| EP | 0577862 | B1 | 3/1997 |

(Continued)

OTHER PUBLICATIONS

Extended European Search Report issued in corresponding application No. 25169426.1 dated Jul. 29, 2025.

*Primary Examiner* — Thomas P Burke

(74) *Attorney, Agent, or Firm* — Carter, DeLuca & Farrell LLP

(57) ABSTRACT

A fuel nozzle has a fuel nozzle body, a set of fuel jets, and a compressed air resonator. The fuel nozzle body has a central channel defining a channel centerline. The set of fuel jets extend through the fuel nozzle body. The set of fuel jets are fluidly coupled to the central channel to define an injecting section of the central channel. The compressed air resonator defines a resonating section of the compressed air channel.

20 Claims, 9 Drawing Sheets

(56) References Cited

U.S. PATENT DOCUMENTS

| | | | | |
|---|---|---|---|---|
| 2011/0083439 | A1* | 4/2011 | Zuo | F23R 3/286 60/737 |
| 2013/0019602 | A1* | 1/2013 | Kim | F23R 3/286 60/725 |
| 2016/0223202 | A1* | 8/2016 | Borchert | F23R 3/002 |
| 2018/0163967 | A1* | 6/2018 | Arellano | F23R 3/286 |
| 2023/0194090 | A1* | 6/2023 | Samarasinghe | F23R 3/005 60/725 |
| 2023/0212984 | A1 | 7/2023 | Vise et al. | |
| 2024/0085024 | A1* | 3/2024 | Engelhardt | F23R 3/286 |

FOREIGN PATENT DOCUMENTS

| | | | |
|---|---|---|---|
| EP | 2549189 | A2 | 1/2013 |
| EP | 2837883 | A1 | 2/2015 |
| EP | 4198397 | A1 | 6/2023 |
| IT | 202300006636 | A1 | 7/2023 |
| WO | 2019105540 | A1 | 6/2019 |

* cited by examiner

FUEL NOZZLE FOR A TURBINE ENGINE COMBUSTOR

TECHNICAL FIELD

The present subject matter relates generally to a fuel nozzle, and more specifically to a turbine engine having a combustion section including the fuel nozzle.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

The use of hydrocarbon fuels in the combustor of a turbine engine is known. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted byproducts, such as nitrogen oxide and nitrogen dioxide (collectively called $NO_x$), carbon monoxide (CO), unburned hydrocarbon (UHC) (e.g., methane and volatile organic compounds that contribute to the formation of atmospheric ozone), and other oxides, including oxides of sulfur (e.g., $SO_2$ and $SO_3$).

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
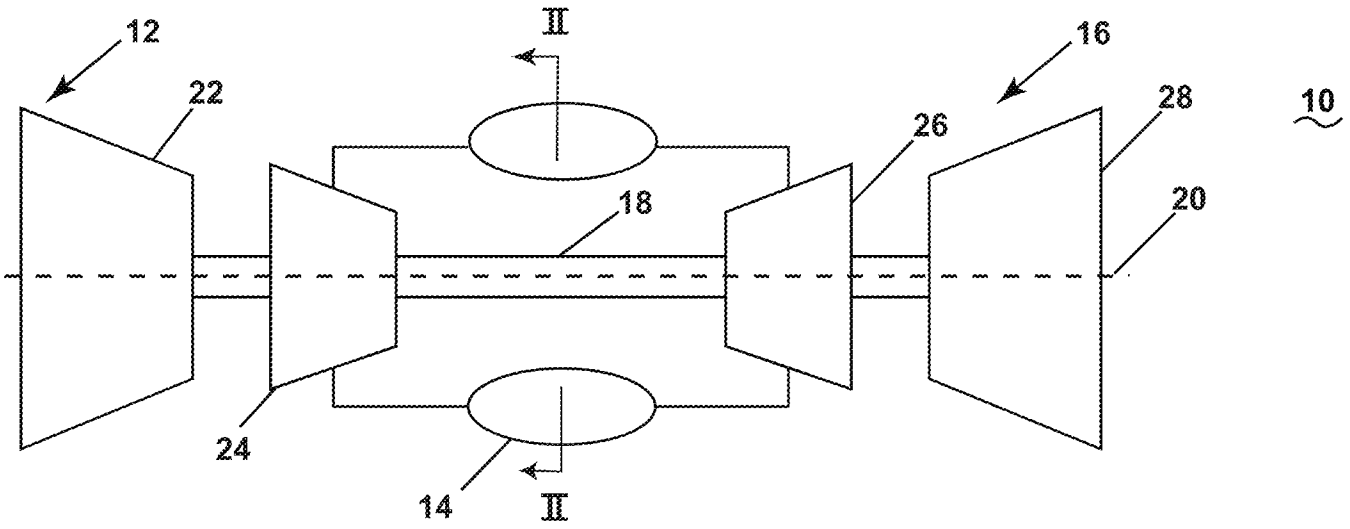
FIG. 1 is a schematic representation of a turbine engine, the turbine engine including a compression section, a combustion section, and a turbine section.

Aspects of the disclosure described herein are directed to a turbine engine including a combustion section. The combustion section includes a fuel nozzle. The fuel nozzle includes a fuel nozzle body defining a central channel. The central channel has an injecting section and a resonating section. The resonating section includes a compressed air resonator.

During operation, a flow of compressed air is fed through the compressed air resonator and into the central channel as a pressure wave. The pressure wave is used to offset or otherwise dampen the effect of acoustic oscillations or acoustic pressure waves that are generated during combustion of a fuel within the combustion chamber.

The fuel nozzle is especially well adapted for the use of hydrogen fuel (hereinafter, "H2 fuel"). Specifically, the fuel nozzle is especially well adapted to feed a flow of H2 fuel to the combustion chamber. The flow of H2 fuel can include a gaseous H2 fuel, a liquid H2 fuel, or a combination thereof. The flow of H2 fuel can further be mixed with other fuels or fluids such as, but not limited to, natural gas, coke oven gas, diesel, Jet-A, or the like. H2 fuels, when compared to traditional fuels (e.g., carbon fuels, petroleum fuels, etc.), have a higher burn temperature and velocity. When ignited, H2 fuels generate relatively large acoustic pressure waves in comparison with traditional fuels. The use of the compressed air resonator offsets or otherwise dampens the effects of the acoustic pressure waves associated with the ignition of H2 fuels.

As used herein, the term "gaseous fuel" or iterations thereof refers to a combustible fuel in a gaseous state. It will be appreciated that gaseous fuel is different from atomized fuel. Atomized fuel utilizes an impeller, orifices, or the like to take a liquid fuel and atomize the liquid fuel into very small droplets.

For purposes of illustration, the present disclosure will be described with respect to a turbine engine (gas turbine engine). It will be understood, however, that aspects of the disclosure described herein are not so limited and that a fuel nozzle as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first" and "second" may be used interchangeably to distinguish one component from another and are not intended to signify location or importance of the individual components.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

FIG. 1 is a schematic view of a turbine engine 10. As a non-limiting example, the turbine engine 10 can be used within an aircraft. The turbine engine 10 includes, at least, a compression section 12, a combustion section 14, and a turbine section 16 in serial flow arrangement. A drive shaft 18 rotationally couples the compression section 12 and the turbine section 16, such that rotation of one affects the rotation of the other, and defines a rotational axis or engine centerline 20 for the turbine engine 10.

The compression section 12 can include a low-pressure (LP) compressor 22, and a high-pressure (HP) compressor 24 serially fluidly coupled to one another. The turbine section 16 can include an LP turbine 28, and an HP turbine 26 serially fluidly coupled to one another. The drive shaft 18 operatively couples the LP compressor 22, the HP compressor 24, the LP turbine 28 and the HP turbine 26 together. Alternatively, the drive shaft 18 can include an LP drive shaft (not illustrated) and an HP drive shaft (not illustrated). The LP drive shaft couples the LP compressor 22 to the LP turbine 28, and the HP drive shaft couples the HP compressor 24 to the HP turbine 26. An LP spool is defined as the combination of the LP compressor 22, the LP turbine 28, and the LP drive shaft such that the rotation of the LP turbine 28 applies a driving force to the LP drive shaft, which in turn rotates the LP compressor 22. An HP spool is defined as the combination of the HP compressor 24, the HP turbine 26, and the HP drive shaft such that the rotation of the HP turbine 26 applies a driving force to the HP drive shaft which in turn rotates the HP compressor 24.

The compression section 12 includes a plurality of axially spaced stages. Each stage includes a set of circumferentially-spaced rotating blades and a set of circumferentially-spaced stationary vanes. The compressor blades for a stage of the compression section 12 can be mounted to a disk, which is mounted to the drive shaft 18. Each set of blades for a given stage can have its own disk. The vanes of the compression section 12 can be mounted to a casing which can extend circumferentially about the turbine engine 10. It will be appreciated that the representation of the compression section 12 is merely schematic and that there can be any number of stages. Further, it is contemplated, that there can be any other number of components within the compression section 12.

Similar to the compression section 12, the turbine section 16 includes a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 is provided serially between the compression section 12 and the turbine section 16. The combustion section 14 is fluidly coupled to at least a portion of the compression section 12 and the turbine section 16 such that the combustion section 14 at least partially fluidly couples the compression section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compression section 12 via a fan (not illustrated) upstream of the compression section 12, where the air is compressed defining a compressed air. The compressed air then flows into the combustion section 14 where the compressed air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The compressed air flow and the combustion gases can together define a working air flow that flows through the fan, compression section 12, combustion section 14, and turbine section 16 of the turbine engine 10.

Figure 2:
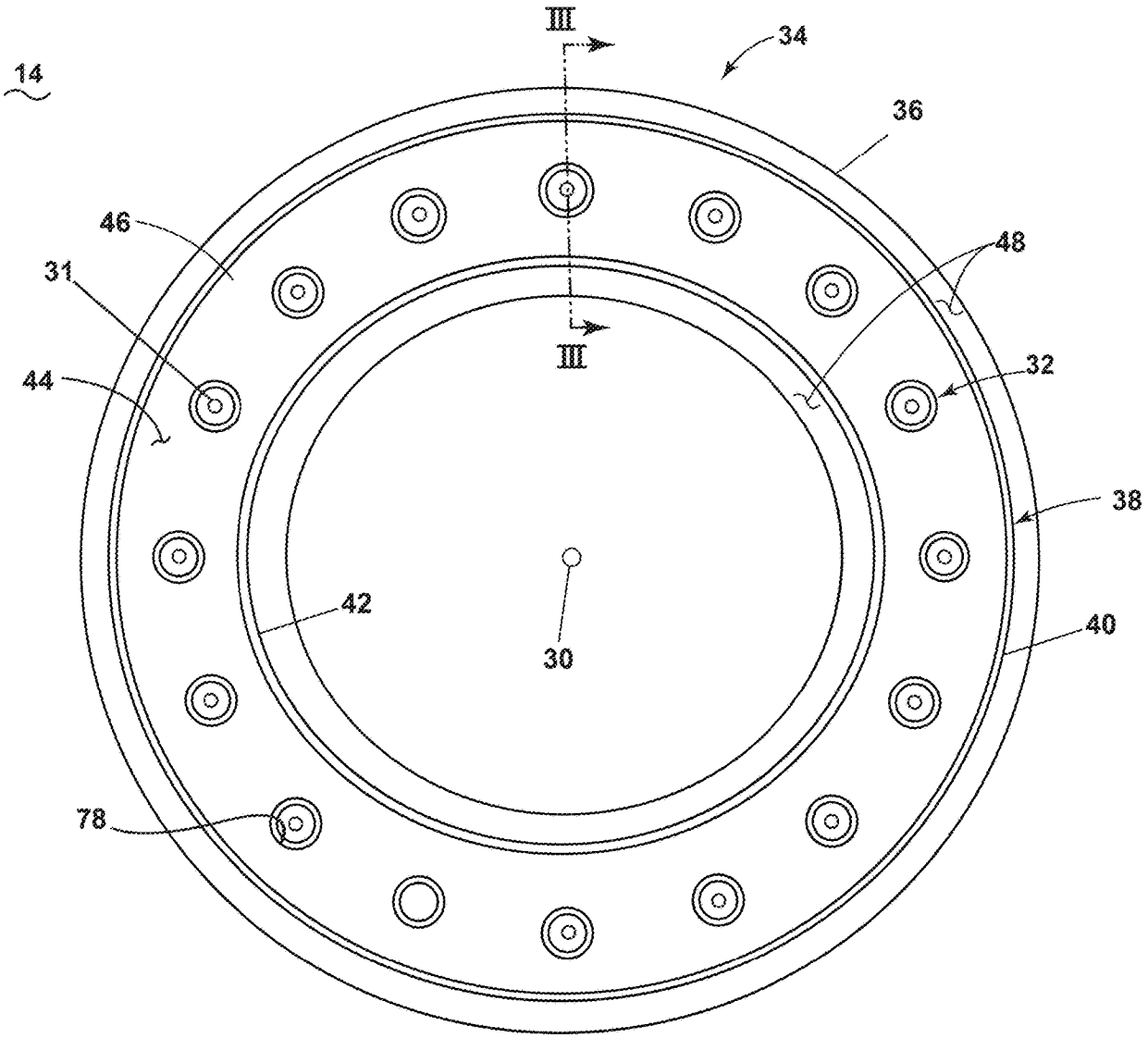
FIG. 2 depicts a sectional view of the combustion section taken along line II-II of FIG. 1, further illustrating a set of fuel nozzles.

FIG. 2 depicts a cross-sectional view of the combustion section 14 along line II-II of FIG. 1. For purposes of illustration, the drive shaft 18 (FIG. 1) has been removed. The combustion section 14 includes a combustor 34. The combustor 34 includes a dome wall 44 including a set of fuel nozzle openings 78. The combustor 34 includes a set of fuel nozzle assemblies 32 extending through the set of fuel nozzle openings. The set of fuel nozzle assemblies 32 are annularly arranged about a combustor centerline 30. The combustor centerline 30 can be the engine centerline 20 (FIG. 1) of the turbine engine 10 (FIG. 1). Additionally, or alternatively, the combustor centerline 30 can be a centerline for the combustion section 14, a single combustor, or a set of combustors that are arranged about the combustor centerline 30. Each fuel nozzle assembly of the set of fuel nozzle assemblies 32 includes a fuel nozzle assembly centerline 31. Each fuel nozzle assembly of the set of fuel nozzle assemblies 32 includes a fuel nozzle. Each fuel nozzle assembly of the set of fuel nozzle assemblies 32 can include any number of one or more fuel nozzles. As used herein, the fuel nozzle is a body including a central channel (not illustrated) that supplies a flow of fuel and/or compressed air to the combustion section 14.

The set of fuel nozzle assemblies 32 can include rich cups, lean cups, or a combination of both rich and lean cups annularly provided about the engine centerline. It should be appreciated that the annular arrangement of fuel nozzle assemblies can be one or multiple fuel nozzle assemblies and one or more of the fuel nozzle assemblies can have different characteristics. The combustor 34 is defined, at least in part, by a combustor liner 38. The combustor 34 can have a can, can-annular, or annular arrangement depending on the type of engine in which the combustor 34 is located. In a non-limiting example, the combustor 34 can have a combination arrangement as further described herein located within a casing 36 of the engine. The combustor liner 38, as illustrated by way of example, can be annular. The combustor liner 38 can include an outer combustor liner 40 and an inner combustor liner 42 concentric with respect to each other and annular about the engine centerline. The dome wall 44 together with the combustor liner 38 can define a combustion chamber 46 having an annular configuration disposed about the combustor centerline 30. The set of fuel nozzle assemblies 32 can be fluidly coupled to the combustion chamber 46. A compressed air passageway 48 can be defined at least in part by both the combustor liner 38 and the casing 36.

Figure 3:
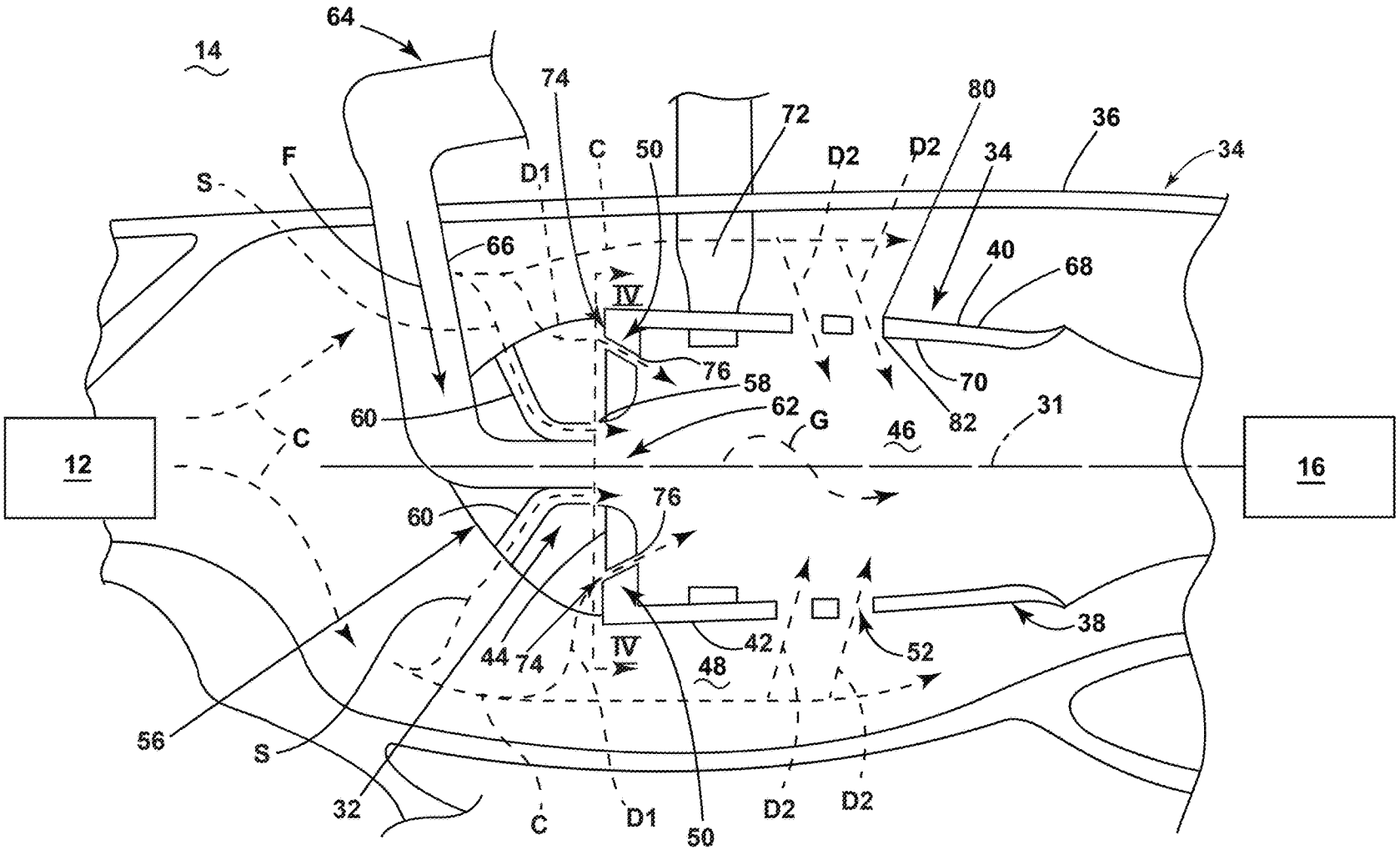
FIG. 3 is a schematic of a side sectional view taken along line III-III of FIG. 2, further illustrating a fuel nozzle exhausting into a combustion chamber.

FIG. 3 depicts a cross-section view taken along line III-III of FIG. 2 illustrating the combustion section 14. At least one flame shaping passage can fluidly connect compressed air and the combustion chamber 46. By way of example, the at least one flame shaping passage is illustrated as a first set of flame shaping holes 50 or a second set of flame shaping holes 52. The combustor 34 can include the first set of flame shaping holes 50, the second set of flame shaping holes 52, or both the first set of flame shaping holes 50 and the second set of flame shaping holes 52.

The first set of flame shaping holes 50 pass through the dome wall 44, fluidly coupling compressed air from the compression section 12 or the compressed air passageway 48 to the combustion chamber 46. The second set of flame shaping holes 52 pass through the combustor liner 38, fluidly coupling compressed air from the compressed air passageway 48 to the combustion chamber 46.

Each fuel nozzle assembly of the set of fuel nozzle assemblies 32 can be coupled to and disposed within a dome assembly 56. Each fuel nozzle assembly of the set of fuel nozzle assemblies 32 can include a flare cone 58 and a swirler 60. The flare cone 58 includes an outlet 62 directly fluidly coupled to the combustion chamber 46. Each fuel nozzle assembly of the set of fuel nozzle assemblies 32 is fluidly coupled to a fuel inlet 64 via a passageway 66.

Both the inner combustor liner 42 and the outer combustor liner 40 have an outer surface 68 and an inner surface 70 at least partially defining the combustion chamber 46. The combustor liner 38 can be made of one continuous monolithic portion or multiple monolithic portions assembled together to define the inner combustor liner 42 and the outer combustor liner 40. By way of non-limiting example, the outer surface 68 can define a first piece of the combustor liner 38 while the inner surface 70 can define a second piece of the combustor liner 38 that when assembled together form the combustor liner 38. As described herein, the combustor liner 38 includes the second set of flame shaping holes 52. It is further contemplated that the combustor liner 38 can be any type of combustor liner 38, including but not limited to a single wall or a double walled liner or a tile liner. An ignitor 72 can be provided at the combustor liner 38 and fluidly coupled to the combustion chamber 46, at any location, by way of non-limiting example upstream of the second set of flame shaping holes 52.

During operation, a compressed air (C) from a compressed air supply, such as the LP compressor 22 or the HP compressor 24 of FIG. 1, can flow from the compression section 12 to the combustor 34. A portion of the compressed air (C) can flow through the dome assembly 56. A first part of the compressed air (C) flowing through the dome assembly 56 can be fed to each fuel nozzle assembly of the set of fuel nozzle assemblies 32 via the swirler 60 as a swirled airflow(S). A flow of fuel (F) is fed to each fuel nozzle assembly of the set of fuel nozzle assemblies 32 via the fuel inlet 64 and the passageway 66. The swirled airflow(S) and the flow of fuel (F) are mixed at the flare cone 58 and fed to the combustion chamber 46 as a fuel/air mixture. The ignitor 72 can ignite the fuel/air mixture to define a flame within the combustion chamber 46, which generates a combustion gas (G). While shown as starting axially downstream of the outlet 62, it will be appreciated that the fuel/air mixture can be ignited at or near the outlet 62.

A second part of the compressed air (C) flowing through one or more portions of the dome assembly 56 can be fed to the first set of flame shaping holes 50 as a first flame shaping airflow (D1). That is, a portion of the compressed air (C) from the compression section 12 (FIG. 1) can flow through the dome wall 44 and into the combustion chamber 46 by passing through the first set of flame shaping holes 50. An inlet 74 is defined by a portion of one or more flame shaping holes of the first set of flame shaping holes 50. The inlet 74 is fluidly coupled to the compressed air (C). The first flame shaping airflow (D1) enters the one or more flame shaping holes of the first set of flame shaping holes 50 at the inlet 74 and exits the one or more flame shaping holes of the first set of flame shaping holes 50 at an outlet 76 located at the dome wall 44.

Another portion of the compressed air (C) can flow through the compressed air passageway 48 and can be fed to the second set of flame shaping holes 52 as a second flame shaping airflow (D2). In other words, another portion of the compressed air (C) can flow axially past the dome assembly 56 and enter the combustion chamber 46 by passing through the second set of flame shaping holes 52. That is, compressed air (C) can flow through the combustor liner 38 and into the combustion chamber 46 by passing through the second set of flame shaping holes 52.

The first flame shaping airflow (D1) can be used to direct and shape the flame. The second flame shaping airflow (D2) can be used to direct the combustion gas (G). In other words, the first set of flame shaping holes 50 or the second set of flame shaping holes 52 extending through the dome wall 44 or the combustor liner 38, respectively, direct air into the combustion chamber 46, where the directed air is used to control, shape, cool, or otherwise contribute to the combustion process in the combustion chamber 46.

The combustor 34 shown in FIG. 3 is well suited for the use of a hydrogen-containing gas as the fuel because it helps contain the faster moving flame front associated with hydrogen fuel, as compared to traditional hydrocarbon fuels. However, the combustor 34 can be used with traditional hydrocarbon fuels.

Figure 4:
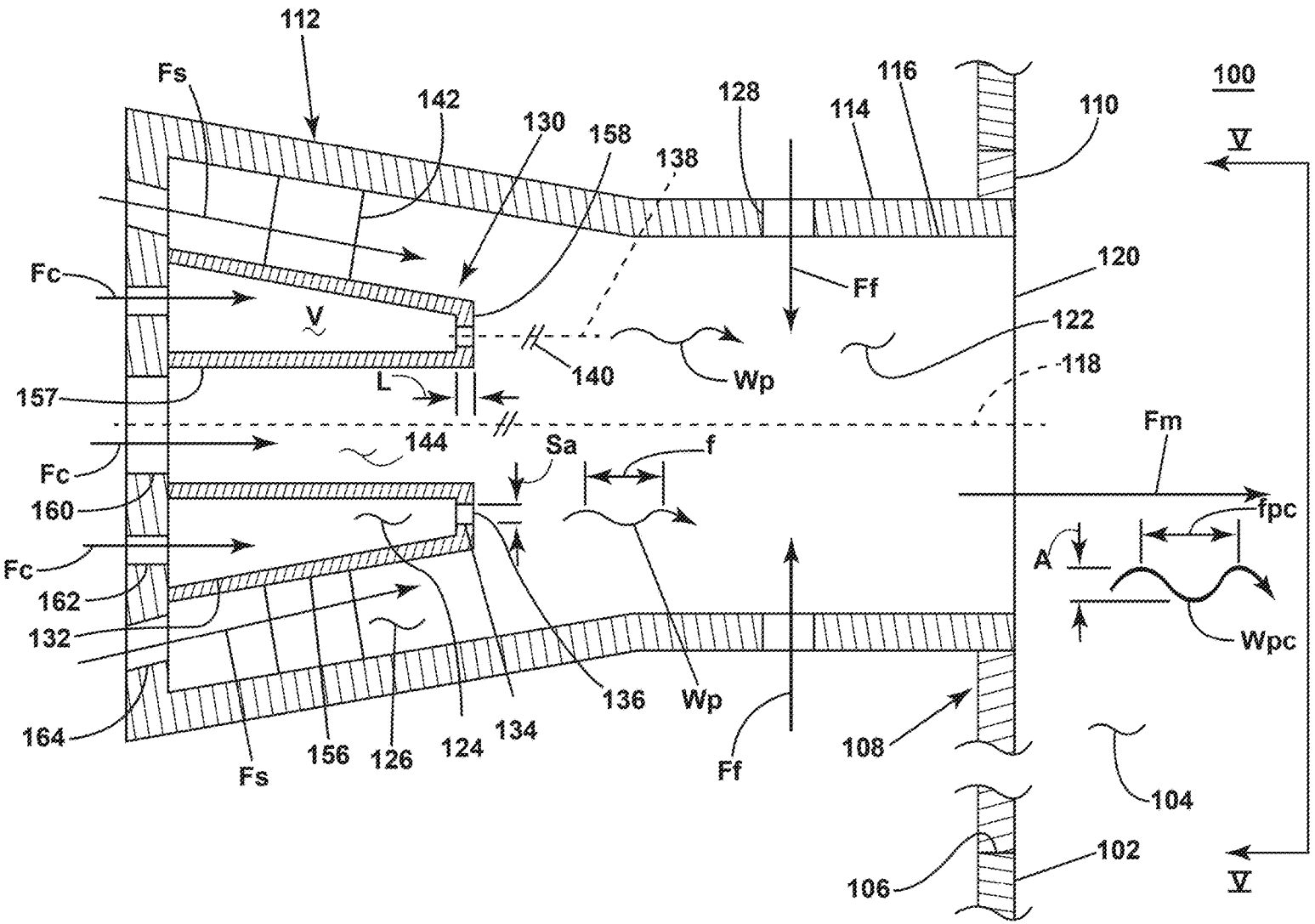
FIG. 4 is a schematic side cross-sectional view of a combustion section suitable for use within the combustion section of FIG. 1, the combustion section including a fuel nozzle having a compressed air resonator.

FIG. 4 is a schematic side cross-sectional view of a combustion section 100 suitable for use as the combustion section 14 of FIG. 1. The combustion section 100 is similar to the combustion section 14, therefore, like parts will be identified with like names with it being understood that the description of the combustion section 14 applies to the combustion section 100 unless noted otherwise.

The combustion section 100 includes a wall 102 at least partially defining a combustion chamber 104. The wall 102 is any suitable wall or combination of walls such as, but not limited to, a dome wall (e.g., the dome wall 44 of FIG. 2), a combustor liner (e.g., the combustor liner 38 of FIG. 2), or a combination thereof. The wall 102 includes a fuel nozzle opening 106.

The combustion section 100 includes a fuel nozzle 112 extending through the fuel nozzle opening 106. The fuel nozzle 112 includes a fuel nozzle body 114. The fuel nozzle 112 can be mounted to a fuel nozzle combustor wall 110. The fuel nozzle 112 and the fuel nozzle combustor wall 110 collectively define a fuel nozzle assembly 108. The fuel nozzle combustor wall 110 contacts respective portions of the wall 102. The fuel nozzle combustor wall 110 is sized to fit within the fuel nozzle opening 106. The fuel nozzle combustor wall 110 can sit flush with the wall 102 along a surface of the wall 102 confronting the combustion chamber 104. The fuel nozzle combustor wall 110 is coupled to the wall 102 through any suitable coupling method such as, but not limited to, adhesion, welding, fastening, threading, or the like. The fuel nozzle body 114 and the fuel nozzle combustor wall 110 are integrally or non-integrally formed.

The fuel nozzle body 114 defines a central channel 116. The central channel 116 opens at a fuel nozzle outlet 120. Specifically, the central channel 116 opens to the combustion chamber 104 at a fuel nozzle outlet 120. The central channel 116 includes a channel centerline 118. The central channel 116 is split into a plurality of sections including at least an injecting section 122 and a resonating section 124. The central channel 116 can include any additional sections such as, but not limited to, a swirler section 126.

The injecting section 122 defines a portion of the central channel 116 where fuel is injected into the central channel 116. The fuel nozzle 112 includes a set of fuel jets 128 extending through respective portions of the fuel nozzle body 114 and opening to the central channel 116. The set of fuel jets 128 are formed as channels or passages extending through the fuel nozzle body 114.

The swirler section 126 defines a portion of the central channel 116 configured to swirl a flow of fluid within the swirler section 126. The swirler section 126 includes a swirler 142 defined any suitable structure configured to impart a tangential momentum to a flow of fluid flowing over the swirler 142. As a non-limiting example, the swirler 142 can be a vane with an airfoil cross section. The amount of swirling that the swirler 142 imparts on a fluid flowing over the swirler 142 is quantified by a swirl number. The swirl number is an integral of the tangential momentum to the axial momentum of the flow of fluid downstream of a respective swirler 142. The swirler 142 creates a swirled flow of fluid having swirl number of greater than 0 and less than or equal to 2.0 The swirler section 126 defines a section of the central channel 116 that extends circumferentially continuously or non-continuously about an entirety or less than an entirety of the channel centerline 118. The swirler section 126 can include any number of one or more swirlers 142. As a non-limiting example, the swirler section 126 can include a plurality of swirlers 142 circumferentially spaced about the channel centerline 118.

The resonating section 124 defines a portion of the central channel 116 configured to output a flow of fluid into the central channel 116 defined by a series of pressure waves at a desired frequency. The resonating section 124 includes a compressed air resonator 130. The compressed air resonator 130 includes at least one wall defining a resonator chamber 132. As a non-limiting example, the compressed air resonator 130 can include a first resonator wall 156, a second resonator wall 157, and a third resonator wall 158. The first resonator wall 156 is provided radially outward from the second resonator wall 157, with respect to the channel centerline 118. The third resonator wall 158 interconnects the first resonator wall 156 and the second resonator wall 157. At least one of the first resonator wall 156, the second resonator wall 157, or a combination thereof is coupled to or integrally formed with fuel nozzle body 114.

The compressed air resonator 130 includes a set of resonator channels 134. The set of resonator channels 134 open to the central channel 116 at a set of resonator orifices 136. The set of resonator channels 134 fluidly couple the resonator chamber 132 to the central channel 116. The set of resonator channels 134 extend through at least one of the first resonator wall 156, the second resonator wall 157, the third resonator wall 158, any other resonator wall, or a combination thereof. As a non-limiting example, the set of resonator orifices 136 are provided along the third resonator wall 158.

Each resonator channel of the set of resonator channels 134 includes a resonator centerline 138. The resonator centerline 138 extends at a resonator channel angle 140 with respect to the channel centerline 118 at a respective resonator orifice of the set of resonator orifices 136. The resonator channel angle 140, as illustrated, is zero degrees such that the resonator centerline 138 at the resonator orifice 136 is parallel to the channel centerline 118. The resonator channel angle 140 is greater than or equal to −90 degrees and less than or equal to 90 degrees.

Each resonator channel of the set of resonator channels 134 extends a length (L) between the resonator chamber 132 and a respective resonator orifice of the set of resonator orifices 136. The length (L) is greater than or equal to 0.1 in and less than or equal to 2 in.

Each resonator orifice of the set of resonator orifices 136 includes a respective surface area (Sa). The surface area (Sa) is a 2-dimensional area that the respective resonator orifice extends. Each resonator orifice of the set of resonator orifices 136 has any suitable shape such as, but not limited to, a circular shape, a rectangular shape, a triangular shape, or the like. As a non-limiting example, the respective resonator orifice of the set of resonator orifices 136 has a circular shape such that the surface area (Sa) of the respective resonator orifice is calculated through the equation $Sa=\pi r^2$, where "r" is the radius of the circle. The surface area (Sa) is greater than or equal to 0.00001 $in^2$ and less than or equal to 0.01 $in^2$.

The resonator chamber 132 includes a volume (V). The volume (V) is a 3-dimensional area that the resonator chamber 132 inhabits. The volume (V) is greater than or equal to 0.0005 $in^3$ and less than or equal to 1.0 $in^3$.

The resonating section 124 extends continuously or non-continuously about an entirety of or less than the entirety of channel centerline 118. As a non-limiting example, resonating section 124 extends continuously about the entirety of the channel centerline 118 such that the resonator chamber 132 defines a continuous annulus when viewed along a plane perpendicular to the channel centerline 118 and intersecting the resonator chamber 132. As a non-limiting example, the compressed air resonator 130, and therefore the resonator chamber 132, can be circumferentially segmented (e.g., formed as circumferentially spaced bodies) about the channel centerline 118.

The resonating section 124 can take any suitable shape. As a non-limiting example, at least one of the first resonator wall 156, the second resonator wall 157, or a combination thereof diverges radially outward from the third resonator wall 158, with respect to the channel centerline 118, such that the resonating section 124 includes a converging cross-sectional area from an axially forward to axially aft portion, with respect to the channel centerline 118, when viewed along a plane extending along the channel centerline 118 and intersecting the resonating section 124. As a non-limiting example, the resonating section 124 can have at least one of a rectangular cross section, a triangular cross section, a semi-circular cross section, or any other suitable shaped cross section when viewed along a plane extending along the channel centerline 118 and intersecting the resonating section 124.

The set of resonator channels 134 includes any number of one or more resonator channels extending along any suitable portion of the compressed air resonator 130. The set of resonator orifices 136 includes any number of one or more orifices opening to respective portions of the central channel 116.

The resonating section 124 and the swirler section 126 are provided axially forward of the injecting section 122, with respect to the channel centerline 118. The swirler section 126 circumscribes the resonating section 124 and is provided radially outward from the resonating section 124, with respect to the channel centerline 118. The swirler section 126 is defined by a radial space between resonating section 124 and the fuel nozzle body 114. The swirler 142 can extend between the resonating section 124 (e.g., the first resonator wall 156) and the fuel nozzle body 114. The resonating section 124 terminates radially prior to the channel centerline 118 such to define a center 144. The center 144 forms a portion of the central channel 116. The swirler section 126 can be formed as a single, continuous channel extending circumferential about an entirety of or less than the entirety of the channel centerline 118. The swirler section 126 can be formed as a multiple, discrete channels circumferentially spaced about the channel centerline 118.

The fuel nozzle 112 includes a set of compressed air inlets extending through respective portions of the fuel nozzle body 114 and opening to respective portions of the central channel 116. A first compressed air inlet 160 of the set of compressed air inlets extends through the fuel nozzle body 114 and opens to the center 144. A second compressed air inlet 162 of the set of compressed air inlets extends through the fuel nozzle body 114 and opens to the resonating section 124, specifically the resonator chamber 132. A third compressed air inlet 164 of the set of compressed air inlets can extend through the fuel nozzle body 114 and open to the swirler section 126. The set of compressed air inlets take any suitable form such as, but not limited to, a series of channels or openings that extend circumferentially continuously or non-continuously about an entirety of or less than an entirety of the channel centerline 118. The fuel nozzle 112 is symmetric or non-symmetric about the channel centerline 118.

The fuel nozzle 108 includes any suitable cross-section. As a non-limiting example, the fuel nozzle 108 includes a radially converging cross-section from an axially forward portion of eth fuel nozzle body 110 to the injecting section 122. As a non-limiting example, the central channel 112 radially converges from an upstream end where the swirler section 124 is provided and to a downstream end where the injecting section 122 begins.

During operation, a flow of compressed air (Fc) is fed to the central channel 116 through at least one compressed air inlet of the set of compressed air inlets (e.g., the first compressed air inlet 160, the second compressed air inlet 162, the third compressed air inlet 164, or a combination thereof). The flow of compressed air (Fc) is from at least one upstream section of the turbine engine (e.g., the turbine engine 10 of FIG. 1) such as, but not limited to, a compression section (e.g., the compression section 12 of FIG. 1).

A first portion of the flow of compressed air (Fc) is fed to the center 144. A second portion of the flow of compressed air (Fc) is fed to the resonator chamber 132. A third portion of the flow of compressed air (Fc) can be fed through the swirler section 126 and swirled by the swirler 142. Each of the first portion, the second portion, and the third portion of the flow of compressed air (Fc) is quantified by a percentage of the overall volume of the flow of compressed air (Fc) fed to the central channel 116. As a non-limiting example, the second portion is greater than 0% and less than or equal to 2% of the overall volume of the flow of compressed air (Fc) that is fed to the central channel 116.

A flow of fuel (Ff) is fed to the central channel 116 through the set of fuel jets 128. The flow of fuel (Ff) is any suitable fuel or combination of fuels such as, but not limited to, an H2 fuel. As a non-limiting example, the flow of fuel (Ff) can include an H2 fuel mixed with at least one of steam, water, another fuel (e.g., Jet-A, diesel, natural gas, coke oven gas, etc.), or a combination thereof. It is contemplated that the flow of fuel (Ff) can include a flow of 100% H2 fuel, or a mixture of H2 fuel and compressed air or another fuel (e.g., methane).

The flow of fuel (Ff) is mixed with the flow of compressed air (Fc) to define a mixed flow of fuel and air (Fm). The mixed flow of fuel and air (Fm) is fed to the combustion chamber 104 through the fuel nozzle outlet 120. The mixed flow of fuel and air (Fm) is ignited within the combustion chamber 104 to define a flame within the combustion chamber 104. The combustion of the mixed flow of fuel and air (Fm) generates combustion pressure waves (Wpc) within the combustion chamber 104. The combustion pressure waves (Wpc) are defined by a combustion frequency (fpc) and amplitude (A). The combustion frequency (fpc) is greater than or equal to 200 Hertz and less than or equal to 50000 Hertz. The combustion frequency (fpc) varies greatly based on the characteristics of the mixed flow of fuel and air (Fm) (e.g., a profile of the mixed flow of fuel and air (Fm), an amount of fuel within the mixed flow of fuel and air (Fm), etc.), and a geometry of the combustion chamber 104 where the mixed flow of fuel and air (Fm) is ignited.

The portion of the flow of compressed air (Fc) (e.g., the second portion) flows through the set of resonator channels 134, out the set of resonator orifices 136 and into a respective portion of the central channel 116. The compressed air resonator 130 is used to generate pressure waves (Wp). Specifically, a portion of the flow of compressed air (Fc) is fed to the volume (V) of the resonator chamber 132. The portion of the flow of compressed air (Fc) within the resonator chamber 132 is then fed through the set of resonator channels 134 and into the central channel 116 as the pressure waves (Wp).

The pressure waves (Wp) oscillate at a frequency (f). The frequency (f) is based on a geometry (e.g., the volume (V), surface area (Sa), and length (L)) of the compressed air resonator 130. The frequency (f) is greater than or equal to 400 Hertz and less than or equal to 5000 Hertz. It has been found that equation (1), below, can be used to calculate the frequency (f) of the pressure waves (Wp) in relation to the geometry of the compressed air resonator 130.

$$f = \left(\frac{c}{2\pi}\right)\sqrt{\left(\frac{S}{VL}\right)} \tag{1}$$

Where "c" is the speed of sound. Table I, below, uses the equation (1) to determine exemplary parameters of the volume (V), the length (L), and the surface area (Sa) that are used to generate the pressure waves (Wp) at the listed frequencies. Table I lists three possible non-limiting embodiments. Table I outlines the sizing the resonator chamber 132 (the volume (V)) assuming that the length (L) and the surface area (Sa) are held constant for each example. A first example ("example 1") assumes the surface area (Sa) is 0.000314 $in^2$ and a length (L) of 0.1 in, a second example ("example 2") assumes the surface area (Sa) is 0.0000785 $in^2$ and a length (L) of 0.1 in, while the third example ("example 3") assumes the surface area (Sa) is 0.000126 $in^2$ and a length (L) of 0.2 in.

TABLE I

| | f (Hertz) | Sa (in) | L (in) | V (in) |
|---|---|---|---|---|
| | 5000 | 3.14E–04 | 0.1 | 1.71E–03 |
| Example | 2000 | 3.14E–04 | 0.1 | 1.07E–02 |
| 1 | 1600 | 3.14E–04 | 0.1 | 1.67E–02 |
| | 1200 | 3.14E–04 | 0.1 | 2.97E–02 |
| | 800 | 3.14E–04 | 0.1 | 6.68E–02 |
| | 400 | 3.14E–04 | 0.1 | 2.67E–01 |
| | 5000 | 7.85E–05 | 0.1 | 4.27E–04 |
| Example | 2000 | 7.85E–05 | 0.1 | 2.67E–03 |
| 2 | 1600 | 7.85E–05 | 0.1 | 4.17E–03 |
| | 1200 | 7.85E–05 | 0.1 | 7.42E–03 |
| | 800 | 7.85E–05 | 0.1 | 1.67E–02 |
| | 400 | 7.85E–05 | 0.1 | 6.68E–02 |
| | 5000 | 1.26E–03 | 0.1 | 3.42E–03 |
| Example | 2000 | 1.26E–03 | 0.2 | 2.14E–02 |
| 3 | 1600 | 1.26E–03 | 0.2 | 3.34E–02 |
| | 1200 | 1.26E–03 | 0.2 | 5.93E–02 |
| | 800 | 1.26E–03 | 0.2 | 1.34E–01 |
| | 400 | 1.26E–03 | 0.2 | 5.34E–01 |

Table I is a non-limiting example of three exemplary examples of the compressed air resonator 130. The geometry of the compressed air resonator 130 can be selected and adjusted based on the desired frequency (f). As outlined in the table above, if the surface area (Sa) and the length (L) are held constant, a smaller volume (V) will generate the pressure waves (Wp) at a higher frequency, while a larger volume (V) will generate the pressure waves (Wp) at a lower frequency.

During operation, it is contemplated that at least some of the combustion pressure waves (Wpc) can flow backwards and into the fuel nozzle 108. The pressure waves (Wp) interact with these combustion pressure waves (Wpc) that flow into the fuel nozzle 108. This interaction between the combustion pressure waves (Wpc) and the pressure waves (Wp) is called phase interaction. The frequency (f) of the pressure waves (Wp) is selected to reduce the amplitude (A) of the combustion pressure waves (Wpc) through the phase interaction. As a non-limiting example, the pressure waves (Wp) are selected to be at a frequency (f) or combination of frequencies that dampens the amplitude (A) of the combustion pressure waves (Wpc) with respect to the amplitude (A) if the compressed air resonator 130 were not included. As used herein, the term "dampen" or iterations thereof in relation to frequencies refers to the reduction of the amplitude of a given wave. As a non-limiting example, the generation of the pressure waves (Wp) at the frequency (f) has been found to dampen the amplitude (A) of the combustion pressure waves (Wpc).

It is contemplated that the pressure waves (Wp) within the central channel 116 cause the mixed flow of fuel and air (Fm) to have a frequency (e.g., have a wave formation). Put another way, the mixed flow of fuel and air (Fm) includes the pressure waves (Wp) such that a form of the pressure waves (Wp) is fed to the combustion chamber 104. The pressure waves (Wp) interact with the combustion pressure waves (Wpc) and at least partially offset the combustion pressure waves (Wpc), thus lowering the overall amplitude (A) of the combustion pressure waves (Wpc).

The dampening of the combustion pressure waves (Wpc) has been found to reduce the negative impacts associated with the combustion pressure waves (Wpc). As a non-limiting example, combustion pressure waves (Wpc) with a higher amplitude have been found to create acoustic oscillations within the combustion chamber 104 that if left unchecked can damage sections of the combustion section 100, or otherwise cause undesired flow characteristics or profiles of the flame or combustion gases associated with the combustion of the mixed flow of fuel and air (Fm). The undesired flow characteristics or profiles of the flame can, in turn, create a non-uniform temperature distribution or flow distribution at a combustor outlet that is ultimately fed to a downstream portion of the turbine engine (e.g., the turbine section 16 of FIG. 1). As such, leaving the combustion pressure waves (Wpc) unchecked (e.g., undampened by the compressed air resonator 130) at least one of damages the combustion section 100, reduces the efficiency of the combustion section 100, or a combination thereof.

The dampening of the combustion pressure waves (Wpc) is especially important when the flow of fuel (Ff) contains a H2 fuel. H2 fuel, in comparison with conventional fuels, has a higher flame speed. The higher flame speed, in turn, generates combustion pressure waves (Wpc) having a higher amplitude (A) than the amplitude (A) of the combustion pressure waves (Wpc) of traditional fuels. If left unchecked, the combustion pressure waves (Wpc) associated with H2 fuels can damage the combustion section 100 and cause undesired flame shaping at the combustor outlet.

The combustion section 100 includes any number of one or more fuel nozzle assemblies 108. Each fuel nozzle assembly 108 of the combustion section 100 extends through a respective portion of the wall 102. Each fuel nozzle assembly 108 can be identical or non-identical to each other. As a non-limiting example, a first fuel nozzle assembly 108 can output the pressure wave (Wp) at a frequency (f) having a first value, while a second fuel nozzle assembly 108 can output the pressure wave (Wp) at a frequency (f) having a second value, different from the first value. The variation of the frequency (f) between fuel nozzle assemblies 108 is used to offset the anticipated combustion pressure waves (Wpc). As a non-limiting example, an ignited fuel and air mixture from a first fuel nozzle assembly 108 can generate a combustion pressure wave (Wpc) having an amplitude (A) with a first value, while an ignited fuel and air mixture from a second fuel nozzle assembly 108 can generate a combustion pressure wave (Wpc) having an amplitude (A) with a second value, different from the first value. The frequency (f) of the pressure waves (Wp) output from the respective fuel nozzle assembly 108 is based on the anticipated combustion pressure wave (Wpc) generated by the ignition of the mixture of fuel and air emitted from the respective fuel nozzle assembly 108.

Figure 5:
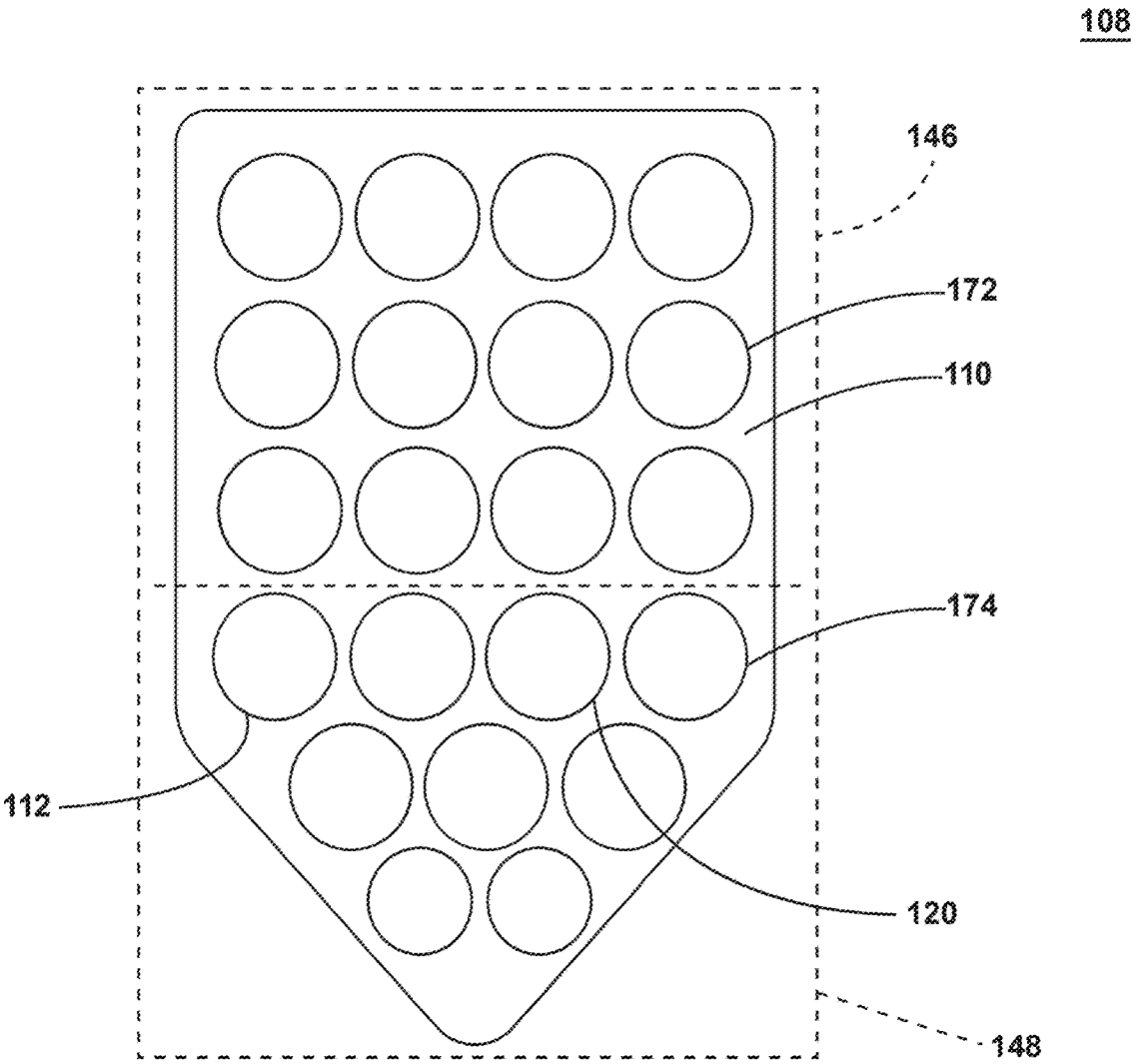
FIG. 5 is a schematic view of the fuel nozzle as seen from sight line V-V of FIG. 4, further illustrating the fuel nozzle included within a plurality of fuel nozzles forming a fuel nozzle assembly.

FIG. 5 is a schematic view of the fuel nozzle 112 as seen from sight line V-V of FIG. 4. The fuel nozzle 112 is included within a plurality of fuel nozzles 112 extending through respective portions of the fuel nozzle combustor wall 110. Each fuel nozzle of the plurality of fuel nozzles 112 includes a respective fuel nozzle outlet 120.

The fuel nozzle combustor wall 110 includes at least one area. As a non-limiting example, the fuel nozzle combustor wall 110 includes a first area 146 and a second area 148. The first area 146 and the second area 148 are each 2-dimensional areas along a portion of the fuel nozzle combustor wall 110 confronting the combustion chamber 104 (FIG. 4). The first area 146 is non-overlapping with the second area 148. The first area 146 and the second area 148 are continuous or non-continuous. As a non-limiting example, the first area 146 can include a portion completely surrounded by the second area 148.

The first area 146 includes a first subset of fuel nozzles 172 of the plurality of fuel nozzles 112. The second area 148 includes a second subset of fuel nozzles 174 of the plurality of fuel nozzles 112. The first subset of fuel nozzles 172 and the second subset of fuel nozzles 174 each include respective compressed air resonators 130 (FIG. 4) generating pressure waves (Wp) (FIG. 4) at respective frequencies (f) (FIG. 4). The first subset of fuel nozzles 172 of the plurality of fuel nozzles 112 generate pressure waves (Wp) at a first frequency (f). The second subset of fuel nozzles 174 of the plurality of fuel nozzles 112 generate pressure waves (Wp) at a second frequency (f). The first frequency is non-equal (e.g., greater than or larger than) to the second frequency. There are any number of one or more fuel nozzles of the set of fuel nozzles 112 per area. There can be any number of one or more areas per fuel nozzle assembly 108. Each area includes at least one fuel nozzle of the plurality of fuel nozzles 112.

The fuel nozzle combustor wall 110 includes any number of one or more areas. As a non-limiting example, each fuel nozzle of the plurality of fuel nozzles 112 can generate pressure waves (Wp) at equal frequencies (f) such that the fuel nozzle combustor wall 110 includes a single area.

The fuel nozzle combustor wall 110, as illustrated, includes a shield shape. It will be appreciated that the fuel nozzle combustor wall 110 can take any suitable shape. As a non-limiting example, the fuel nozzle combustor wall 110 can be, but is not limited to, a rectangle, a circle, an ellipse, a trapezoid, a spiral, a racetrack, or the like.

Breaking the fuel nozzle assembly 108 into various areas or otherwise having two or more fuel nozzle assemblies 108 producing the pressure waves (Wp) at differing frequencies (f), allows for differing frequencies (f) to be targeted. It is contemplated that during operation of the combustion section 100 (FIG. 4), the combustion chamber 104 (FIG. 4) can experience two or more combustion pressure waves (Wpc) (FIG. 4) at differing combustion frequencies (fpc). The differing pressure waves (Wp) at differing frequencies (f) allow for a broad range of combustion pressure waves (Wpc) to be targeted and effectively dampened.

Figure 6:
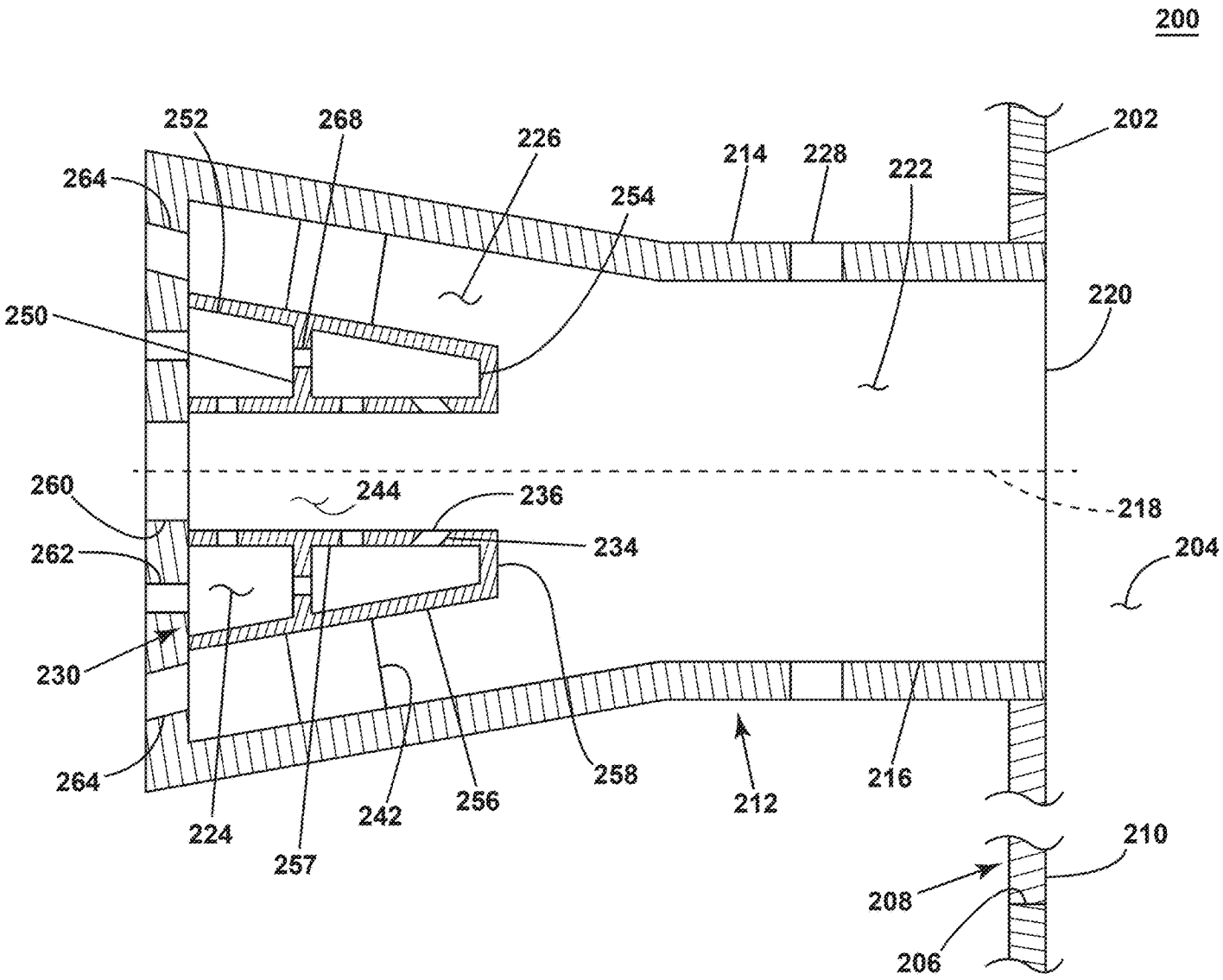
FIG. 6 is a schematic side cross-sectional view of an exemplary combustion section suitable for use within the combustion section of FIG. 4, the combustion section including a fuel nozzle having a compressed air resonator with a first resonator chamber and a second resonator chamber.

FIG. 6 is a schematic side cross-sectional view of an exemplary combustion section 200 suitable for use within the combustion section 100 of FIG. 4. The combustion section 200 is similar to the combustion section 100 (FIG. 4); therefore, like parts will be identified with like numerals increased to the 200 series, with it being understood that the description of the combustion section 100 applies to the combustion section 200 unless noted otherwise.

The combustion section 200 includes a wall 202 at least partially defining a combustion chamber 204. The wall 202 includes a fuel nozzle opening 206. The combustion section 200 includes a fuel nozzle 212 having a fuel nozzle body 214. The fuel nozzle body 214 defines a central channel 216 opening to the combustion chamber 204 at a fuel nozzle outlet 220. The central channel 216 includes a channel centerline 218. The fuel nozzle body 214 extends through the fuel nozzle opening 206. The fuel nozzle 212 can be coupled to or integrally formed with a fuel nozzle combustor wall 210 to collectively form a fuel nozzle assembly 208.

The central channel 216 includes an injecting section 222 and a resonating section 224. The central channel 216 can include a swirler section 226. The injecting section 222 includes a set of fuel jets 228. The swirler section 226 includes a swirler 242. The resonating section 224 includes a compressed air resonator 230. The compressed air resonator 230 includes radially opposing sections to define a center 244 of the central channel 216. The fuel nozzle 212 includes a first compressed air inlet 260 and a second compressed air inlet 262. The first compressed air inlet 260 opens to the center 244. The second compressed air inlet 262 opens to the resonating section 224. The fuel nozzle 212 can include a third compressed air inlet 264 opening to the swirler section 226.

The compressed air resonator 230 is similar to the compressed air resonator 130 (FIG. 4) in that the compressed air resonator 230 includes a set of walls including a first resonator wall 256, a second resonator wall 257, and a third resonator wall 258. Similar to the compressed air resonator 130, at least one chamber is fluidly coupled to the central channel 216 through a set of resonator channels 234 opening to respective portions of the central channel 216 at a set of resonator orifices 236. The difference, however, is that the compressed air resonator 230 includes an interior resonator wall 250 splitting the compressed air resonator 230 into two or more resonator chambers; specifically, a first resonator chamber 252 and a second resonator chamber 254.

As illustrated, the first resonator chamber 252 is axially spaced from the second resonator chamber 254, with respect to the channel centerline 218. However, it will be appreciated that the first resonator chamber 252 is at least one of radially spaced, circumferentially spaced, or axially spaced from the second resonator chamber 254, with respect to the channel centerline 218. The first resonator chamber 252 can be fluidly coupled to the second resonator chamber 254 through a connecting channel 268 within the interior resonator wall 250. Alternatively, the first resonator chamber 252 can be fluidly separate from the second resonator chamber 254.

It is contemplated that the first resonator chamber 252 can have a non-equal volume (e.g., the volume (V) of FIG. 4) to the second resonator chamber 254. Alternatively, the volume of the first resonator chamber 252 can be equal to the volume of the second resonator chamber 254 but at least one other geometric characteristic (e.g., the surface area (Sa) or the length (L) of FIG. 4) can vary. In any case, the pressure waves (e.g., the pressure waves (Wp) of FIG. 4) output from the first resonator chamber 252 have a first frequency (e.g., the frequency (f) of FIG. 4), while the pressure waves output from the second resonator chamber 254 have a second frequency, different from the first frequency. The combustion section 200, therefore, only requires a single fuel nozzle 212 to generate two or more pressure waves (Wp) at two or more frequencies (f).

Figure 7:
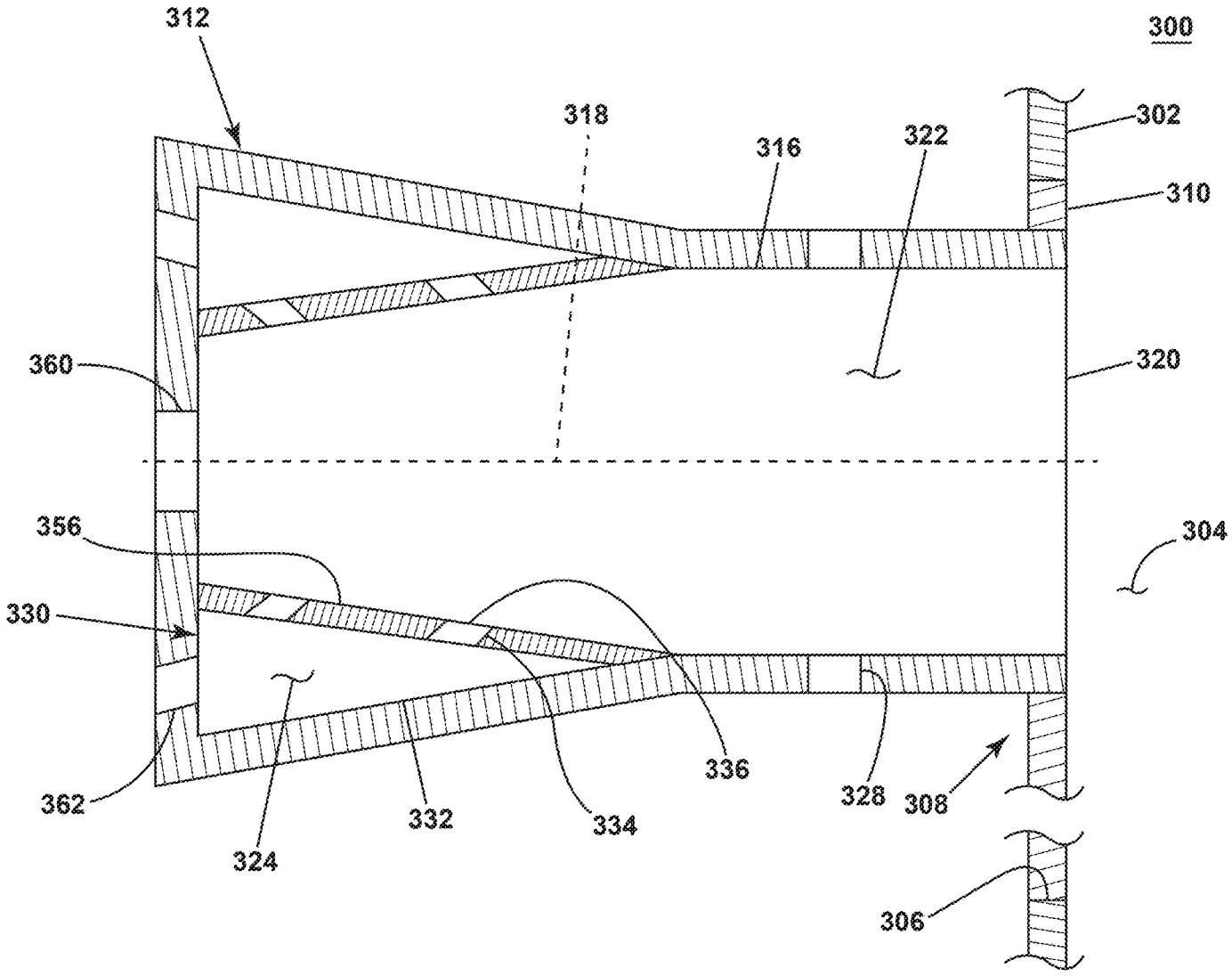
FIG. 7 is a schematic side cross-sectional view of an exemplary combustion section suitable for use within the combustion section of FIG. 4, the combustion section including a fuel nozzle having a fuel nozzle body, and a compressed air resonator including a resonator chamber formed at least partially by the fuel nozzle body.

FIG. 7 is a schematic side cross-sectional view of an exemplary combustion section 300 suitable for use within the combustion section 100 of FIG. 4. The combustion section 300 is similar to the combustion section 100, 200 (FIG. 6); therefore, like parts will be identified with like numerals increased to the 300 series, with it being understood that the description of the combustion section 100, 200 applies to the combustion section 300 unless noted otherwise.

The combustion section 300 includes a wall 302 at least partially defining a combustion chamber 304. The wall 302 includes a fuel nozzle opening 306. The combustion section 300 includes a fuel nozzle 312 having a fuel nozzle body 314. The fuel nozzle body 314 defines a central channel 316 opening to the combustion chamber 304 at a fuel nozzle outlet 320. The central channel 316 includes a channel centerline 318. The fuel nozzle body 314 extends through the fuel nozzle opening 306. The fuel nozzle 312 can be coupled to or integrally formed with a fuel nozzle combustor wall 310 to collectively form a fuel nozzle assembly 308.

The central channel 316 includes an injecting section 322 and a resonating section 324. The injecting section 322 includes a set of fuel jets 328. The resonating section 324 includes a compressed air resonator 330. The compressed air resonator 330 includes radially opposing sections to define a center 344 of the central channel 316. The fuel nozzle 312 includes a first compressed air inlet 360 and a second compressed air inlet 362. The first compressed air inlet 360 opens to the center 344. The second compressed air inlet 362 opens to the resonating section 324.

The fuel nozzle 312 is similar to the fuel nozzle 112 (FIG. 4), 212 (FIG. 5) in that the compressed air resonator 330 includes a resonator wall 356 at least partially defining a resonator chamber 332. The resonator wall 356, however, extends between opposing sections of the fuel nozzle body 314 such that the resonator chamber 332 is formed radially between the resonator wall 356 and the fuel nozzle body 314. The compressed air resonator 330 further includes a set of resonator channels 334 that extend through the resonator wall 356 and open to the central channel 316 at a set of resonator orifices 336. Further, the fuel nozzle 312 does not include a dedicated swirler section (e.g., the swirler section 126 of FIG. 4 or the swirler section 226 of FIG. 6). It is contemplated that the set of resonator channels 334 can extend circumferentially or otherwise be circumferentially oriented such that the pressure waves (e.g., the pressure waves (Wp) of FIG. 4) output from the compressed air resonator 330 have a circumferential component with respect to the channel centerline 318 in order to effectively swirl the flow of compressed air (e.g., the flow of compressed air (Fc) of FIG. 4) in a desired fashion. Put another way, the pressure waves (Wp) output from the compressed air resonator 330 can extend circumferentially into or out of the page such that a swirl is imparted on the flow of compressed air within the central channel 316. As such, the set of resonator channels 334 can be used in place of a swirler (e.g., the swirler 142 of FIG. 4).

Figure 8:
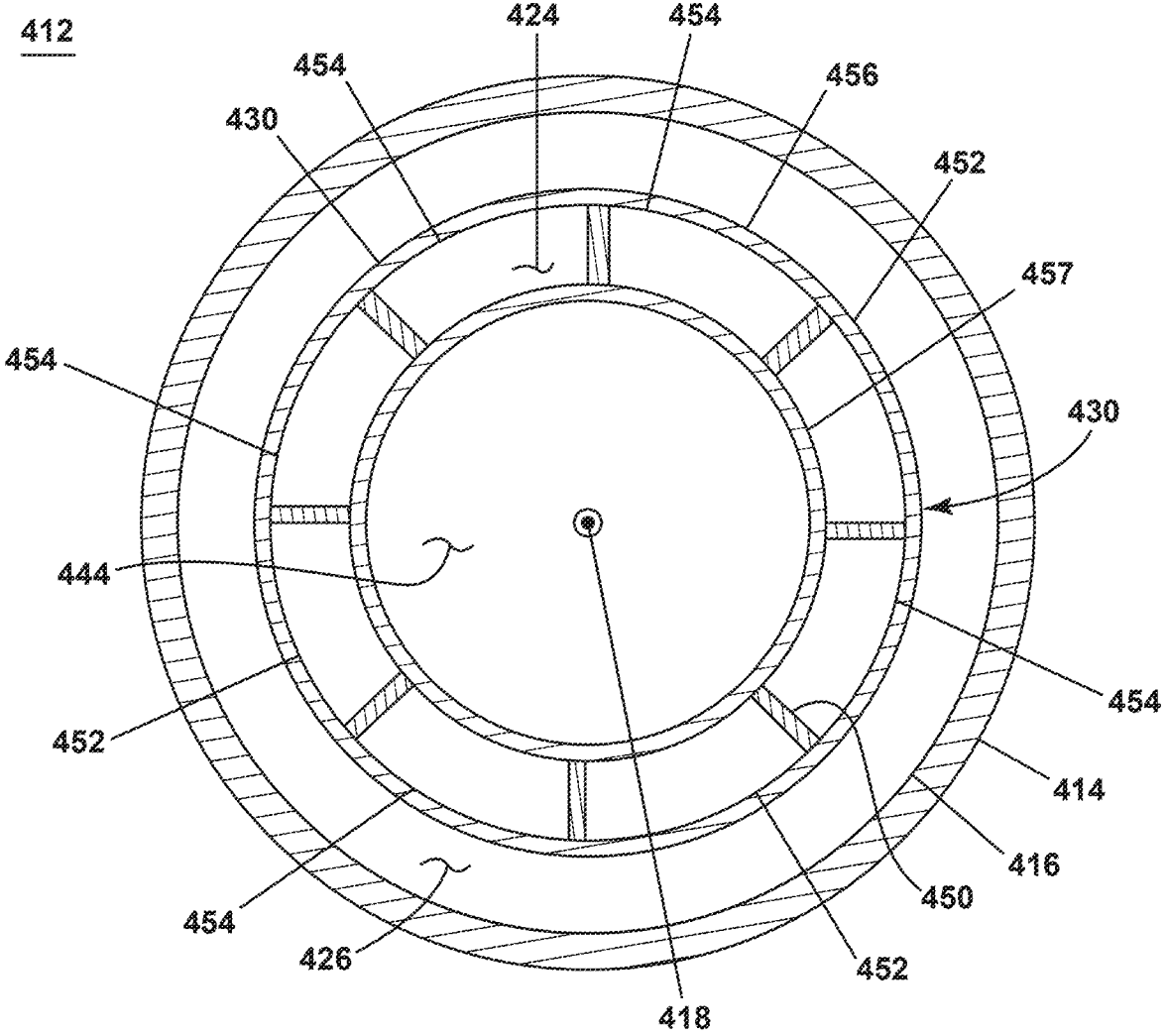
FIG. 8 is a schematic cross-sectional view of an exemplary fuel nozzle suitable for use within the combustion section of FIG. 4, further illustrating a resonating section including a set of circumferentially spaced resonator chambers.

FIG. 8 is a schematic cross-sectional view of an exemplary fuel nozzle 412 suitable for use within the combustion section 100 of FIG. 4. The fuel nozzle 412 is similar to the fuel nozzle 112 (FIG. 4), 212 (FIG. 6), 312 (FIG. 7); therefore, like parts will be identified with like numerals increased to the 400 series, with it being understood that the description of the fuel nozzle 112, 212, 312 applies to the fuel nozzle 412 unless noted otherwise.

The fuel nozzle 412 has a fuel nozzle body 414. The fuel nozzle body 414 defines a central channel 416. The central channel 416 includes a channel centerline 418. The central channel 416 includes a resonating section 424. The central channel 416 can include a swirler section 426. The resonating section 424 includes a compressed air resonator 430. The compressed air resonator 430 includes radially opposing sections to define a center 444 of the central channel 416. The compressed air resonator 430 includes a first resonator wall 456 and a second resonator wall 457. While not illustrated, the compressed air resonator 430 includes a set of resonator channels (e.g., the set of resonator channels 134 of FIG. 4) opening to the central channel 416 at a set of resonator orifices (e.g., the set of resonator orifices 136 of FIG. 4).

The fuel nozzle 412 is similar to the fuel nozzle 212 in that that fuel nozzle 412 includes a first resonator chamber 452 and a second resonator chamber 454 separated by an interior resonator wall 450. The first resonator chamber 452 and the second resonator chamber 454 being sized to generate pressure waves (e.g., the pressure waves (Wp) of FIG. 4) at varying frequencies (e.g., the frequency (f) of FIG. 4). The first resonator chamber 452, however, is circumferentially spaced from the second resonator chamber 454, with respect to the channel centerline 418. As such, the compressed air resonator 430 includes a set of circumferentially spaced resonator chambers.

The set of circumferentially spaced resonator chambers include any suitable arrangement of chambers. As a non-limiting example, the set of resonator chambers includes a circumferentially alternating pattern of the first resonator chamber 452 and the second resonator chamber 454. Alternatively, the arrangement of chambers can take any suitable form such as a non-alternating pattern (e.g., two or more first resonator chambers 452 or second resonator chambers 454 are provided circumferentially adjacent one another). It will be appreciated that the set of chambers can include any number of two or more chambers that produce respective pressure waves (Wp) at any number of two or more frequencies (f).

Figure 9:
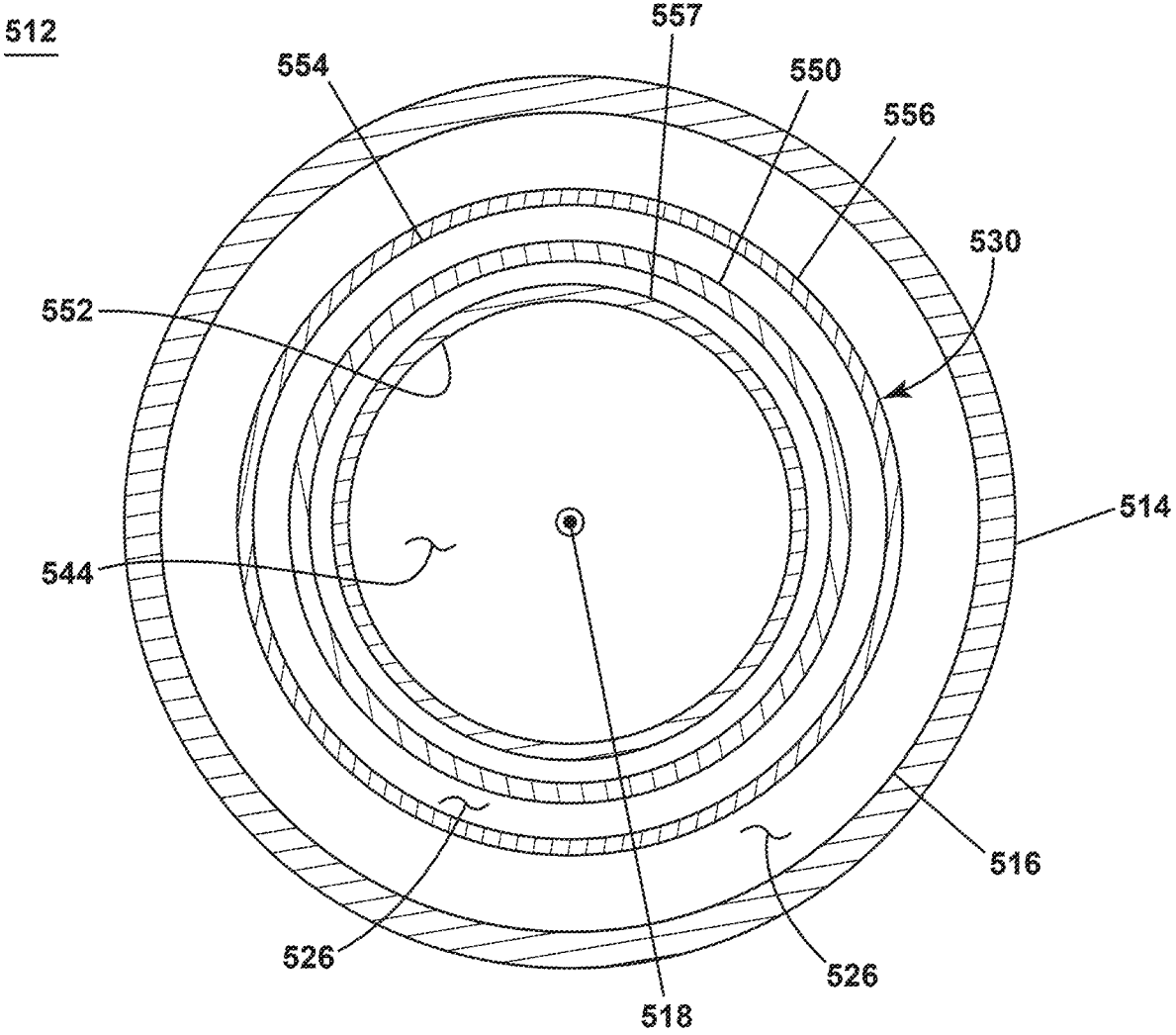
FIG. 9 is a schematic cross-sectional view of an exemplary fuel nozzle suitable for use within the combustion section of FIG. 4, further illustrating a resonating section including a set of radially spaced resonator chambers.

FIG. 9 is a schematic cross-sectional view of an exemplary fuel nozzle 512 suitable for use within the combustion section 100 of FIG. 4. The fuel nozzle 512 is similar to the fuel nozzle 112 (FIG. 4), 212 (FIG. 6), 312 (FIG. 7), 412 (FIG. 8); therefore, like parts will be identified with like numerals increased to the 500 series, with it being understood that the description of the fuel nozzle 112, 212, 312, 412 applies to the fuel nozzle 512 unless noted otherwise.

The fuel nozzle 512 has a fuel nozzle body 514. The fuel nozzle body 514 defines a central channel 516. The central channel 516 includes a channel centerline 518. The central channel 516 includes a resonating section 524. The central channel 516 can include a swirler section 526. The resonating section 524 includes a compressed air resonator 530. The compressed air resonator 530 includes radially opposing sections to define a center 544 of the central channel 516. The compressed air resonator 530 includes a first resonator wall 556 and a second resonator wall 557. While not illustrated, the compressed air resonator 530 includes a set of resonator channels (e.g., the set of resonator channels 134 of FIG. 5) opening to the central channel 516 at a set of resonator orifices (e.g., the set of resonator orifices 136 of FIG. 5).

The fuel nozzle 512 is similar to the fuel nozzle 212 in that that fuel nozzle 512 includes a first resonator chamber 552 and a second resonator chamber 554 separated by an interior resonator wall 550. The first resonator chamber 552 and the second resonator chamber 554 being sized to generate pressure waves (e.g., the pressure waves (Wp) of FIG. 5) at varying frequencies (e.g., the frequency (f) of FIG. 5). The first resonator chamber 552, however, is radially spaced from the second resonator chamber 554, with respect to the channel centerline 518. As such, the compressed air resonator 530 includes a set of circumferentially radially resonator chambers. It will be appreciated that the set of chambers can include any number of two or more chambers that produce respective pressure waves at any number of two or more frequencies.

Benefits associated with the present disclosure include fuel nozzle equipped to offset the acoustic oscillations associated with the generation of the combustion pressure waves. A conventional fuel nozzle does not include the compressed air resonators. Instead, a conventional combustion section including the conventional fuel nozzle can include resonators (e.g., Helmholtz resonators) provided within the combustion chamber. These resonators within the combustion chamber can be used to help dampen the amplitude of the combustion pressure waves, however, require additional structure to be included within the combustion section, thus increasing the complexity of construction of the combustion section. Further, the resonators within the conventional combustion section are provided within an area that may negatively impact the flame profile. The combustion section as described herein, however, includes the fuel nozzles with the compressed air resonator built into the fuel nozzle. The inclusion of the compressed air resonator within the fuel nozzle eliminates the need for a resonator within the combustion chamber, thus reducing the complexity of the combustion section as a whole when compared to the conventional combustion section.

Benefits associated with using hydrogen-containing fuel over traditional fuels include an eco-friendlier engine as the hydrogen-containing fuel, when combusted, generates less carbon pollutants than a combustor using traditional fuels. For example, a combustor including 100% hydrogen-containing fuel (e.g., the fuel is 100% H2) would have zero carbon pollutants. The combustor, as described herein, can be used in instances where 100% hydrogen-containing fuel is used.

To the extent not already described, the different features and structures of the various embodiments can be used in combination, or in substitution with each other as desired. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A fuel nozzle comprising a fuel nozzle body having a central channel defining a channel centerline, the central channel opening at a fuel nozzle outlet, a set of fuel jets extending through the fuel nozzle body and being fluidly coupled to the central channel to define an injecting section of the central channel, and a compressed air resonator provided within the central channel and defining a resonating section of the central channel, the compressed air resonator configured to receive a portion of a flow of compressed air and generate pressure waves that are emitted into the central channel.

The fuel nozzle of any preceding clause, wherein the compressed air resonator includes a resonator chamber and a resonator channel fluidly coupled to the resonator chamber and opening into the central channel at a resonator orifice, the resonator channel having a resonator centerline.

The fuel nozzle of any preceding clause, wherein a projection of the resonator centerline from the resonator orifice is parallel to the channel centerline.

The fuel nozzle of any preceding clause, wherein the compressed air resonator includes an internal wall splitting the resonator chamber into a first resonator chamber and a second resonator chamber, and the resonator channel is included within a plurality of resonator channels fluidly coupling the first resonator chamber and the second resonator chamber to the central channel.

The fuel nozzle of any preceding clause, wherein the first resonator chamber emits respective pressure waves at a first frequency, and the second resonator chamber emits respective pressure waves at a second frequency different from the first frequency.

The fuel nozzle of any preceding clause, wherein the first resonator chamber has a first volume, and the second resonator chamber has a second volume, wherein the second volume is different from the first volume.

The fuel nozzle of any preceding clause, wherein the first resonator chamber is axially spaced from the second resonator chamber, with respect to the channel centerline The fuel nozzle of any preceding clause, wherein the first resonator chamber is circumferentially spaced from the second resonator chamber, with respect to the channel centerline The fuel nozzle of any preceding clause, wherein the first resonator chamber is radially spaced from the second resonator chamber, with respect to the channel centerline.

The fuel nozzle of any preceding clause, wherein the fuel nozzle includes a fuel nozzle body defining the central channel, and a resonator wall extending from the fuel nozzle body and into the central channel, with the resonator chamber being formed between the resonator wall and the fuel nozzle body.

The fuel nozzle of any preceding clause, wherein the resonator orifice is provided along the resonator wall.

The fuel nozzle of any preceding clause, wherein the resonator chamber includes a volume that is greater than or equal to 0.0005 $in^3$ and less than or equal to 1.0 $in^3$.

The fuel nozzle of any preceding clause, wherein the resonator channel extends along the resonator centerline a length that is greater than or equal to 0.1 in and less than or equal to 2 in.

The fuel nozzle of any preceding clause, wherein the resonator orifice includes a surface area that is greater than or equal to 0.00001 $in^2$ and less than or equal to 0.01 $in^2$.

The fuel nozzle of any preceding clause, wherein the pressure waves include a frequency of greater than or equal to 400 Hertz and less than or equal to 5000 Hertz.

The fuel nozzle of any preceding clause, further comprising a swirler provided within the central channel and defining a swirler section of the central channel, the swirler being configured to impart a swirling motion to at least a respective portion of the compressed air passing through the central channel.

The fuel nozzle of any preceding clause, wherein the fuel nozzle is included within a plurality of fuel nozzles comprising a first fuel nozzle, with the resonator section of the first fuel nozzle generating the pressure waves at a first frequency, and a second fuel nozzle, with the resonator section of the second fuel nozzle generating the pressure waves at a second frequency, wherein the second frequency is different from the first frequency.

The fuel nozzle of any preceding clause, wherein the first fuel nozzle and the second fuel nozzle are provided within a fuel nozzle assembly mounted to a singular fuel nozzle combustor wall, the first fuel nozzle is provided within a first plurality of fuel nozzles all outputting the pressure waves at the first frequency, each fuel nozzle outlet of the first plurality of fuel nozzles being provided within a first area of the fuel nozzle combustor wall, and the second fuel nozzle is provided within a second plurality of fuel nozzles all outputting the pressure waves at the second frequency, each fuel nozzle outlet of the second plurality of fuel nozzles being provided within a second area, non-overlapping with the first area, of the fuel nozzle combustor wall.

The fuel nozzle of any preceding clause, wherein the injecting section injects a flow of hydrogen fuel into the fuel nozzle.

The fuel nozzle of any preceding clause, wherein the compressed air resonator includes a first resonator chamber and a second resonator chamber separated by an internal wall.

The fuel nozzle of any preceding clause, wherein the first resonator chamber is circumferentially spaced from the second resonator chamber, with respect to the channel centerline.

The fuel nozzle of any preceding clause, wherein the first resonator chamber is provided within a plurality of first resonator chambers, and the second resonator chamber is provided within a plurality of second resonator chambers.

The fuel nozzle of any preceding clause, wherein the plurality of first resonator chambers are alternately spaced with respect to the plurality of second resonator chambers.

The fuel nozzle of any preceding clause, wherein the plurality of first resonator chambers are non-alternately spaced with respect to the plurality of second resonator chambers.

The fuel nozzle of any preceding clause, wherein the compressed air resonator includes a connecting channel extending through the internal wall land fluidly coupling the first resonator chamber to the second resonator chamber.

The fuel nozzle of any preceding clause, wherein the resonator channel is circumferentially oriented to impart a swirl on a flow of compressed air flowing through the resonator chamber.

The fuel nozzle of any preceding clause, wherein the compressed air resonator includes a resonator chamber, and the fuel nozzle further comprises a compressed air inlet opening into the resonator chamber.

The fuel nozzle of any preceding clause, further comprising a compressed air inlet opening into the central channel.

The fuel nozzle of any preceding clause, further comprising a compressed air inlet opening into the swirler section.

The fuel nozzle of any preceding clause, wherein the resonator chamber includes a volume (V), the resonator channel extends along the resonator centerline a length (L), the resonator orifice includes a surface area (Sa), and the pressure waves include a frequency (f), with the frequency being determined by $$f = \left(\frac{c}{2\pi}\right)\sqrt{\left(\frac{S}{VL}\right)}.$$

A turbine engine comprising a compressor section, a combustion section, and a turbine section in serial flow arrangement, with the compressor section providing a compressed air, and the combustion section comprising a wall at least partially defining a combustion chamber, the wall having a fuel nozzle assembly opening, and the fuel nozzle of any preceding clause provided within the fuel nozzle opening, the fuel nozzle outlet being opening into the combustion chamber.

The turbine engine of any preceding clause, wherein the compressed air resonator includes a resonator chamber and a resonator channel fluidly coupled to the resonator chamber and opening into the central channel at a resonator orifice, the resonator channel having a resonator centerline.

The turbine engine of any preceding clause, wherein a projection of the resonator centerline from the resonator orifice is parallel to the channel centerline.

The turbine engine of any preceding clause, wherein the compressed air resonator includes an internal wall splitting the resonator chamber into a first resonator chamber and a second resonator chamber, and the resonator channel is included within a plurality of resonator channels fluidly coupling the first resonator chamber and the second resonator chamber to the central channel.

The turbine engine of any preceding clause, wherein the first resonator chamber emits respective pressure waves at a first frequency, and the second resonator chamber emits respective pressure waves at a second frequency different from the first frequency.

The turbine engine of any preceding clause, wherein the first resonator chamber has a first volume, and the second resonator chamber has a second volume, wherein the second volume is different from the first volume.

The turbine engine of any preceding clause, wherein the first resonator chamber is axially spaced from the second resonator chamber, with respect to the channel centerline The turbine engine of any preceding clause, wherein the first resonator chamber is circumferentially spaced from the second resonator chamber, with respect to the channel centerline.

The turbine engine of any preceding clause, wherein the first resonator chamber is radially spaced from the second resonator chamber, with respect to the channel centerline.

The turbine engine of any preceding clause, wherein the fuel nozzle includes a fuel nozzle body defining the central channel, and a resonator wall extending from the fuel nozzle body and into the central channel, with the resonator chamber being formed between the resonator wall and the fuel nozzle body.

The turbine engine of any preceding clause, wherein the resonator orifice is provided along the resonator wall.

The turbine engine of any preceding clause, wherein the resonator chamber includes a volume that is greater than or equal to 0.0005 $in^3$ and less than or equal to 1.0 $in^3$.

The turbine engine of any preceding clause, wherein the resonator channel extends along the resonator centerline a length that is greater than or equal to 0.1 in and less than or equal to 2 in.

The turbine engine of any preceding clause, wherein the resonator orifice includes a surface area that is greater than or equal to 0.00001 $in^2$ and less than or equal to 0.01 $in^2$.

The turbine engine of any preceding clause, wherein the pressure waves include a frequency of greater than or equal to 400 Hertz and less than or equal to 5000 Hertz.

The turbine engine of any preceding clause, further comprising a swirler provided within the central channel and defining a swirler section of the central channel, the swirler being configured to impart a swirling motion to at least a respective portion of the compressed air passing through the central channel.

The turbine engine of any preceding clause, wherein the fuel nozzle is included within a plurality of fuel nozzles comprising a first fuel nozzle, with the resonator section of the first fuel nozzle generating the pressure waves at a first frequency, and a second fuel nozzle, with the resonator section of the second fuel nozzle generating the pressure waves at a second frequency, wherein the second frequency is different from the first frequency.

The turbine engine of any preceding clause, wherein the first fuel nozzle and the second fuel nozzle are provided within a fuel nozzle assembly mounted to a singular fuel nozzle combustor wall, the first fuel nozzle is provided within a first plurality of fuel nozzles all outputting the pressure waves at the first frequency, each fuel nozzle outlet of the first plurality of fuel nozzles being provided within a first area of the fuel nozzle combustor wall, and the second fuel nozzle is provided within a second plurality of fuel nozzles all outputting the pressure waves at the second frequency, each fuel nozzle outlet of the second plurality of fuel nozzles being provided within a second area, non-overlapping with the first area, of the fuel nozzle combustor wall.

The turbine engine of any preceding clause, wherein the injecting section injects a flow of hydrogen fuel into the fuel nozzle.

The turbine engine of any preceding clause, wherein the compressed air resonator includes a first resonator chamber and a second resonator chamber separated by an internal wall.

The turbine engine of any preceding clause, wherein the first resonator chamber is circumferentially spaced from the second resonator chamber, with respect to the channel centerline.

The turbine engine of any preceding clause, wherein the first resonator chamber is provided within a plurality of first resonator chambers, and the second resonator chamber is provided within a plurality of second resonator chambers.

The turbine engine of any preceding clause, wherein the plurality of first resonator chambers are alternately spaced with respect to the plurality of second resonator chambers.

The fuel nozzle of any preceding clause, wherein the plurality of first resonator chambers are non-alternately spaced with respect to the plurality of second resonator chambers.

The turbine engine of any preceding clause, wherein the compressed air resonator includes a connecting channel extending through the internal wall land fluidly coupling the first resonator chamber to the second resonator chamber.

The turbine engine of any preceding clause, wherein the resonator channel is circumferentially oriented to impart a swirl on a flow of compressed air flowing through the resonator chamber.

The turbine engine of any preceding clause, wherein the compressed air resonator includes a resonator chamber, and the fuel nozzle further comprises a compressed air inlet opening into the resonator chamber.

The turbine engine of any preceding clause, wherein the fuel nozzle further comprises a compressed air inlet opening into the central channel.

The turbine engine of any preceding clause, wherein the fuel nozzle further comprises a compressed air inlet opening into the swirler section.

The turbine engine of any preceding clause, wherein the resonator chamber includes a volume (V), the resonator channel extends along the resonator centerline a length (L), the resonator orifice includes a surface area (Sa), and the pressure waves include a frequency (f), with the frequency being determined by $$f = \left(\frac{c}{2\pi}\right)\sqrt{\left(\frac{S}{VL}\right)}.$$

What is claimed is:

1. A fuel nozzle for a combustion section having a combustion chamber, the fuel nozzle comprising:

a fuel nozzle body having a central channel defining a channel centerline, the central channel opening at a fuel nozzle outlet, the fuel nozzle outlet opening into the combustion chamber;

a set of fuel jets extending through the fuel nozzle body and fluidly coupled to the central channel to define an injecting section of the central channel;

a compressed air resonator provided within the central channel and defining a resonating section of the central channel, the compressed air resonator configured to receive a portion of a flow of compressed air and generate pressure waves that are emitted into the central channel through a resonator orifice of the compressed air resonator that opens directly into the central channel within the fuel nozzle body and axially upstream of where the set of fuel jets open to the central channel;

a first compressed air inlet formed through the fuel nozzle body and opening into a portion of the central channel exterior to the compressed air resonator; and a second compressed air inlet formed through the fuel nozzle body and opening into the compressed air resonator, the second compressed air inlet being structurally and fluidly separate from the first compressed air inlet.

2. The fuel nozzle of claim 1, wherein the compressed air resonator includes a resonator chamber and a resonator channel fluidly coupled to the resonator chamber and opening into the central channel at the resonator orifice, the resonator channel having a resonator centerline.

3. The fuel nozzle of claim 2, wherein a projection of the resonator centerline from the resonator orifice is parallel to the channel centerline.

4. The fuel nozzle of claim 2, wherein:

the compressed air resonator includes an internal wall splitting the resonator chamber into a first resonator chamber and a second resonator chamber; and the resonator channel is included within a plurality of resonator channels fluidly coupling the first resonator chamber and the second resonator chamber to the central channel.

5. The fuel nozzle of claim 4, wherein:

the first resonator chamber emits respective pressure waves at a first frequency; and the second resonator chamber emits respective pressure waves at a second frequency different from the first frequency.

6. The fuel nozzle of claim 4, wherein the first resonator chamber has a first volume, and the second resonator chamber has a second volume, wherein the second volume is different from the first volume.

7. The fuel nozzle of claim 4, wherein the first resonator chamber is axially spaced from the second resonator chamber, with respect to the channel centerline.

8. The fuel nozzle of claim 2, wherein the fuel nozzle includes a fuel nozzle body defining the central channel, and a resonator wall extending from the fuel nozzle body and into the central channel, with the resonator chamber being formed between the resonator wall and the fuel nozzle body.

9. The fuel nozzle of claim 2, wherein the resonator chamber includes a volume that is greater than or equal to 0.0005 $in^3$ and less than or equal to 1.0 $in^3$.

10. The fuel nozzle of claim 2, wherein the resonator channel extends along the resonator centerline a length that is greater than or equal to 0.1 in and less than or equal to 2 in.

11. The fuel nozzle of claim 2, wherein the resonator orifice includes a surface area that is greater than or equal to 0.00001 $in^2$ and less than or equal to 0.01 $in^2$.

12. A fuel nozzle comprising:

a fuel nozzle body having a central channel defining a channel centerline, the central channel opening at a fuel nozzle outlet;

a set of fuel jets extending through the fuel nozzle body and fluidly coupled to the central channel to define an injecting section of the central channel;

a compressed air resonator provided within the central channel and defining a resonating section of the central channel, the compressed air resonator configured to receive a portion of a flow of compressed air and generate pressure waves that are emitted into the central channel through a resonator orifice of the compressed air resonator that opens directly into the central channel within the fuel nozzle body and axially upstream of where the set of fuel jets open to the central channel, wherein the pressure waves include a frequency of greater than or equal to 400 Hertz and less than or equal to 5000 Hertz;

a first compressed air inlet formed through the fuel nozzle body and opening into a portion of the central channel exterior to the compressed air resonator; and a second compressed air inlet formed through the fuel nozzle body and opening into the compressed air resonator, the second compressed air inlet being structurally and fluidly separate from the first compressed air inlet.

13. The fuel nozzle of claim 1, further comprising a swirler provided within the central channel and defining a swirler section of the central channel, the swirler being configured to impart a swirling motion to at least a respective portion of the compressed air passing through the central channel.

14. The fuel nozzle of claim 1, wherein the fuel nozzle is included within a plurality of fuel nozzles comprising:

a first fuel nozzle, with the resonator section of the first fuel nozzle generating the pressure waves at a first frequency; and a second fuel nozzle, with the resonating section of the second fuel nozzle generating the pressure waves at a second frequency, wherein the second frequency is different from the first frequency.

15. The fuel nozzle of claim 14, wherein:

the first fuel nozzle and the second fuel nozzle are provided within a fuel nozzle assembly mounted to a singular fuel nozzle combustor wall;

the first fuel nozzle is provided within a first plurality of fuel nozzles all outputting the pressure waves at the first frequency, each fuel nozzle outlet of the first plurality of fuel nozzles being provided within a first area of the singular fuel nozzle combustor wall; and the second fuel nozzle is provided within a second plurality of fuel nozzles all outputting the pressure waves at the second frequency, each fuel nozzle outlet of the second plurality of fuel nozzles being provided within a second area, non-overlapping with the first area, of the singular fuel nozzle combustor wall.

16. The fuel nozzle of claim 1, wherein the injecting section injects a flow of hydrogen fuel into the fuel nozzle.

17. A turbine engine comprising:

a compressor section, a combustion section, and a turbine section in serial flow arrangement, with the compressor section providing a compressed air, and the combustion section comprising:

a wall at least partially defining a combustion chamber, the wall having a fuel nozzle assembly opening; and the fuel nozzle of claim 1 provided within the fuel nozzle opening, the fuel nozzle outlet opening into the combustion chamber.

18. The fuel nozzle of claim 13, further comprising a third compressed air inlet opening to the swirler section, the third compressed air inlet being different from the first compressed air inlet and the second compressed air inlet.

19. The fuel nozzle of claim 1, wherein the first compressed air inlet is located radially inward from the second compressed air inlet, with respect to the channel centerline.

20. A fuel nozzle for a combustion section having a combustion chamber, the fuel nozzle comprising:

a fuel nozzle body having a central channel defining a channel centerline, the central channel opening at a fuel nozzle outlet, the fuel nozzle outlet opening into the combustion chamber;

a set of fuel jets extending through the fuel nozzle body and fluidly coupled to the central channel to define an injecting section of the central channel;

a compressed air resonator provided within the central channel and defining a resonating section of the central channel, the compressed air resonator configured to receive a portion of a flow of compressed air and generate pressure waves that are emitted into the central channel through a resonator orifice of the compressed air resonator that opens directly into the central channel within the fuel nozzle body and axially upstream of where the set of fuel jets open to the central channel;

a swirler section located radially outward from the resonating section, with respect to the channel centerline;

a first compressed air inlet formed through the fuel nozzle body and opening into a portion of the central channel exterior to the compressed air resonator; and a second compressed air inlet formed through the fuel nozzle body and opening into the compressed air resonator, the second compressed air inlet being structurally and fluidly separate from the first compressed air inlet.

* * * * *